United States Patent [19]

Wang

[11] Patent Number: 5,026,012

[45] **Date of Patent: * Jun. 25, 1991**

[54] TOWEL SUPPORT

[76] Inventor: Wen-Mu Wang, No. 32, Lane 266, Fu Te I Rd., Hsi Tze Chien, Taipei Hsien, Taiwan

[ * ] Notice: The portion of the term of this patent subsequent to Mar. 13, 2007 has been disclaimed.

[21] Appl. No.: 489,168

[22] Filed: Mar. 6, 1990

[51] Int. Cl.[5] ..... A47G 29/00

[52] U.S. Cl. ..... 248/222.1; 248/251

[58] Field of Search ..... 248/201, 251, 222.1, 248/224.3, 224.4, 315, 544; 16/110 R; 403/299, 306, 378

[56] References Cited

U.S. PATENT DOCUMENTS

| | | | |
|---|---|---|---|
| 1,773,815 | 8/1930 | Hoegger | 248/222.1 |
| 1,891,048 | 12/1932 | Keefe | 248/222.1 |
| 1,893,729 | 1/1933 | Call | 248/222.1 |
| 1,915,479 | 6/1933 | Smith | 248/222.1 |
| 1,934,911 | 11/1933 | Cambell | 248/222.1 |
| 1,997,686 | 4/1935 | Hoegger | 248/222.1 |
| 2,158,734 | 5/1939 | Sladek | 248/251 |
| 2,176,644 | 10/1939 | Sladek | 248/222.1 |
| 2,512,209 | 6/1950 | Marchand | 248/222.1 |
| 4,804,161 | 2/1989 | Wallo | 248/544 |
| 4,907,771 | 3/1990 | Wang | 248/222.1 |

*Primary Examiner*—Ramon O. Ramirez

*Attorney, Agent, or Firm*—Varndell Legal Group

[57] ABSTRACT

A towel support, which includes a wall plate having a projecting stem and elongated mounting holes for easy alignment of flat head screws with anchors which are secured inside a wall, to fasten the wall plate onto the wall, and a connector to secure hanging device to the mounting plate for holding towels. The connector comprises an axial hole into which the stem of the wall plate is inserted, a bolt hole vertically in communication with the axial hole, and a screw rod movably fastening in the bolt hole pressing against the top taper end of the stem to firmly secure the connector thereto.

4 Claims, 4 Drawing Sheets

TOWEL SUPPORT

BACKGROUND AND SUMMARY OF THE INVENTION

The present invention relates towel supports and more particularly to a towel support which is easy to assemble and can be conveniently fastened onto a wall surface.

Various kinds of towel holding devices have been disclosed. In U.S. Pat. No. 4,907,771 there is disclosed a type of hanger for holding towels (as shown in FIG. 1). The hanger includes a mounting plate having a stem extending from its center and holes for fastening of flat head screws to secure the mounting plate onto a wall surface by flat head screws. A connector connects with the stem of the mounting plate by pivot bolt so that a cover plate and an insert can be firmly retained between the mounting plate and the connector. Because the flat head screws are to match with respective anchors which are fastened inside a wall, the holes on the mounting plate must be accurately aligned with the anchors for fastening. If the anchors are not accurately positioned, the screws will be difficult to fix the mounting plate onto the wall. Further, the connector is secured to the stem of the mounting plate by fastening a bolt through a pivot hole on the connector into a longitudinal hole on the stem. Before fixing, the pivot hole of the connector must be accurately aligned with the longitudinal hole of the stem for the fastening therein of the bolt.

U.S. Pat. No. 1,997,686 discloses a kind of fixture support which is illustrated in FIGS. 2, 3 and 4. This fixture support has a supporting member attached to a supporting surface and a supported member fitting over the supporting member and which is formed in two parts comprising a wall flange and a shank. Similar to the aforesaid problems, the mounting holes of the supporting member must be accurately aligned with the corresponding anchors within a wall so that screw means can be fastened to secure the mounting member to such a wall, the supported member shall also be accurately aligned with the groove on the stem so that a screw can be threaded in to secure the mounted member to the mounting member.

The main object of the present invention is to a towel support which can eliminate the aforesaid problems. A towel support of the present invention includes a mounting member having elongated holes for easy alignment with anchors set within a wall surface so that flat head screws can be conveniently fastened to secure the mounting member onto a wall. A tapered stem projects from the mounting member at the center onto which a cap-like connector is mounted and firmly secured thereto by a pivot bolt. Because of the tapered surface of the upper end of the stem, the connector is firmly secured to the stem of the mounting member after the pivot bolt is threaded down. By means of this arrangement, no aligning procedure is required before fastening up the pivot bolt.

DETAILED DESCRIPTION OF THE PREFERRED EMBODIMENT

Figure 1:
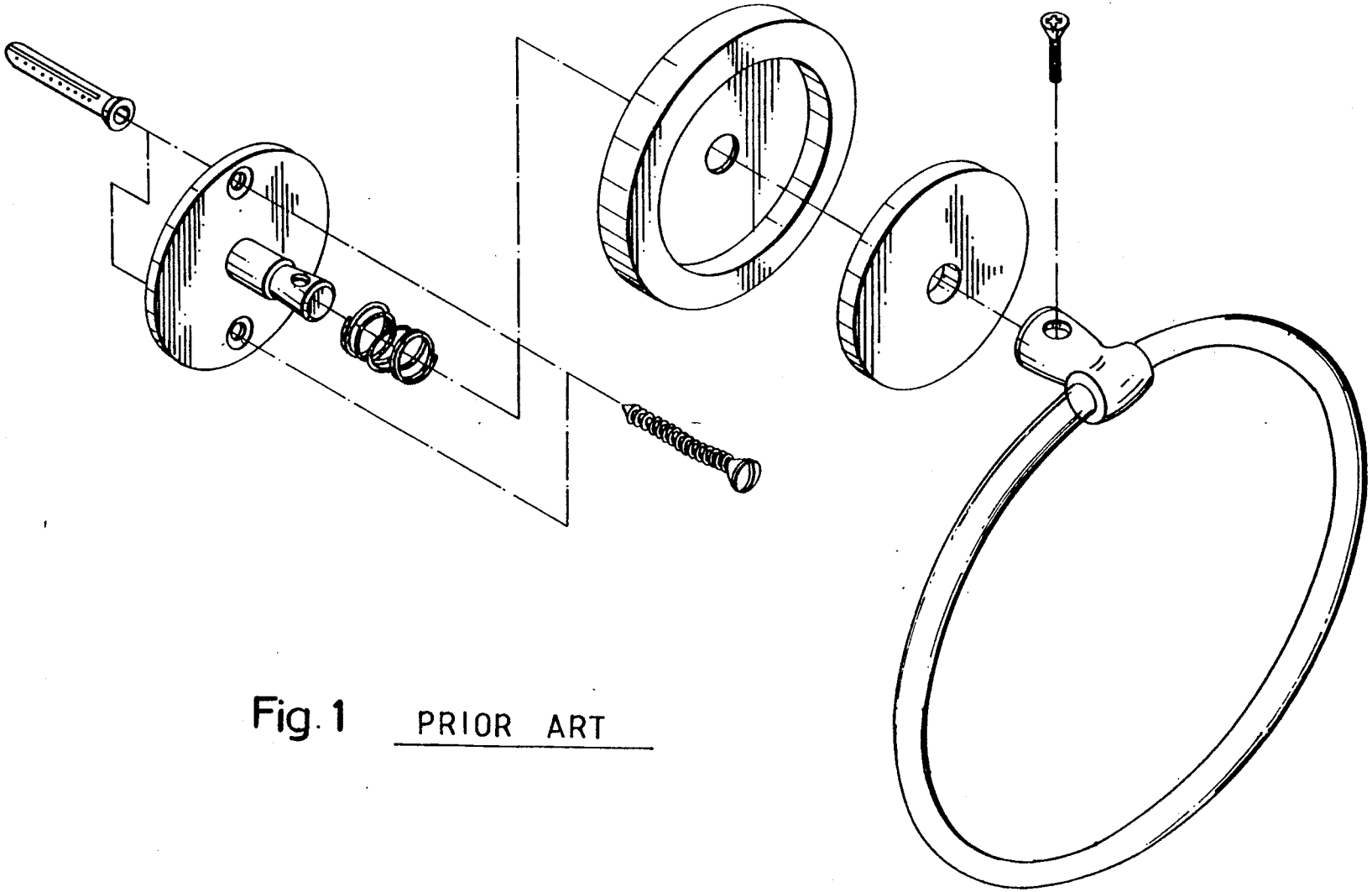
Fig. 1 PRIOR ART
FIG. 1 is a perspective exploded view of a hanger of the prior art.
Figure 3:
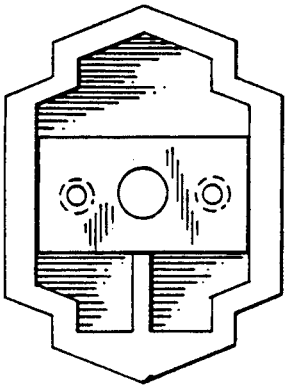
Fig. 3 PRIOR ART
FIG. 3 is a front view of the fixture support of FIG. 2.
Figure 2:
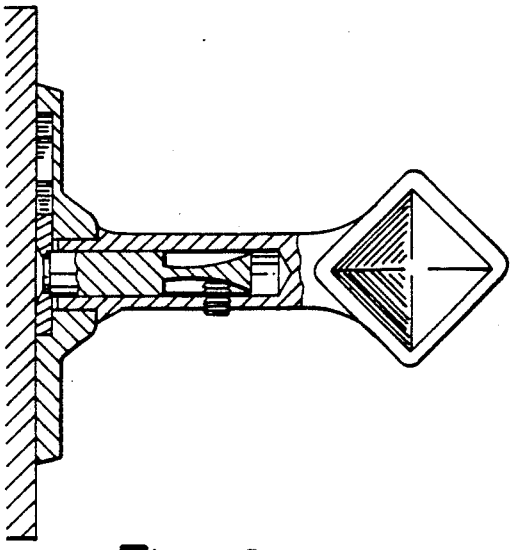
Fig. 2 PRIOR ART
FIG. 2 is an elevation partly in section of a fixture support of the prior art.
Figure 4:
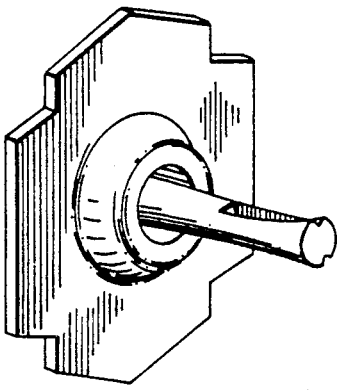
Fig. 4 PRIOR ART
FIG. 4 illustrates the structure of the stem of the fixture support of FIG. 2.
Figure 5:
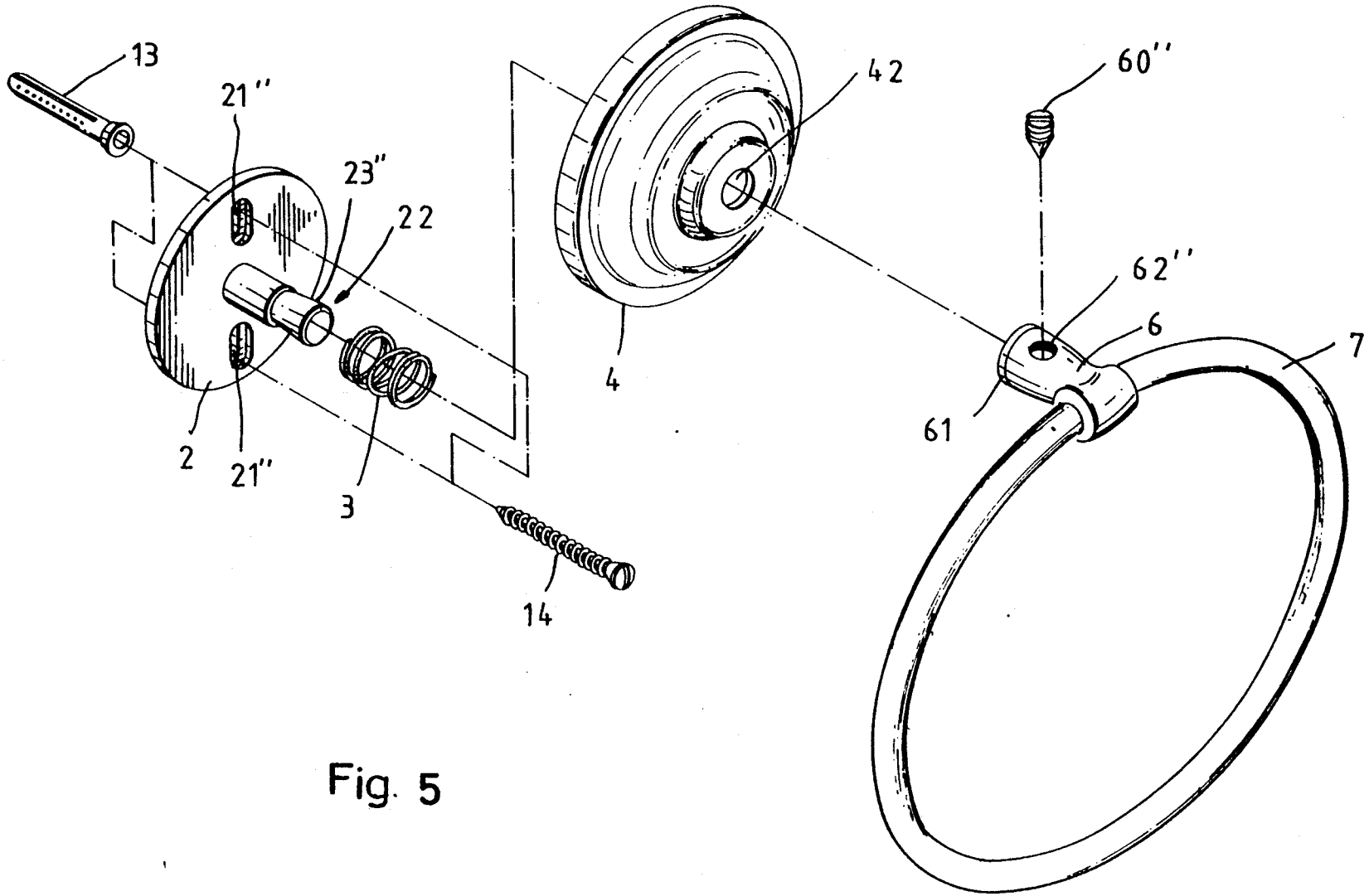
FIG. 5 is a perspective exploded view of a towel support according to the present invention.
Figure 7:
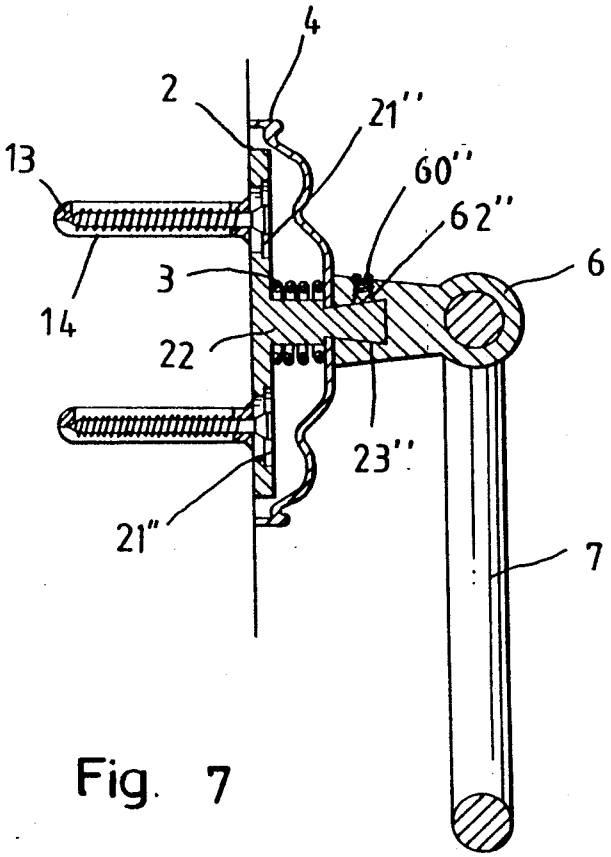
FIG. 7 is a sectional assembly view of the embodiment of FIG. 5.
Figure 6:
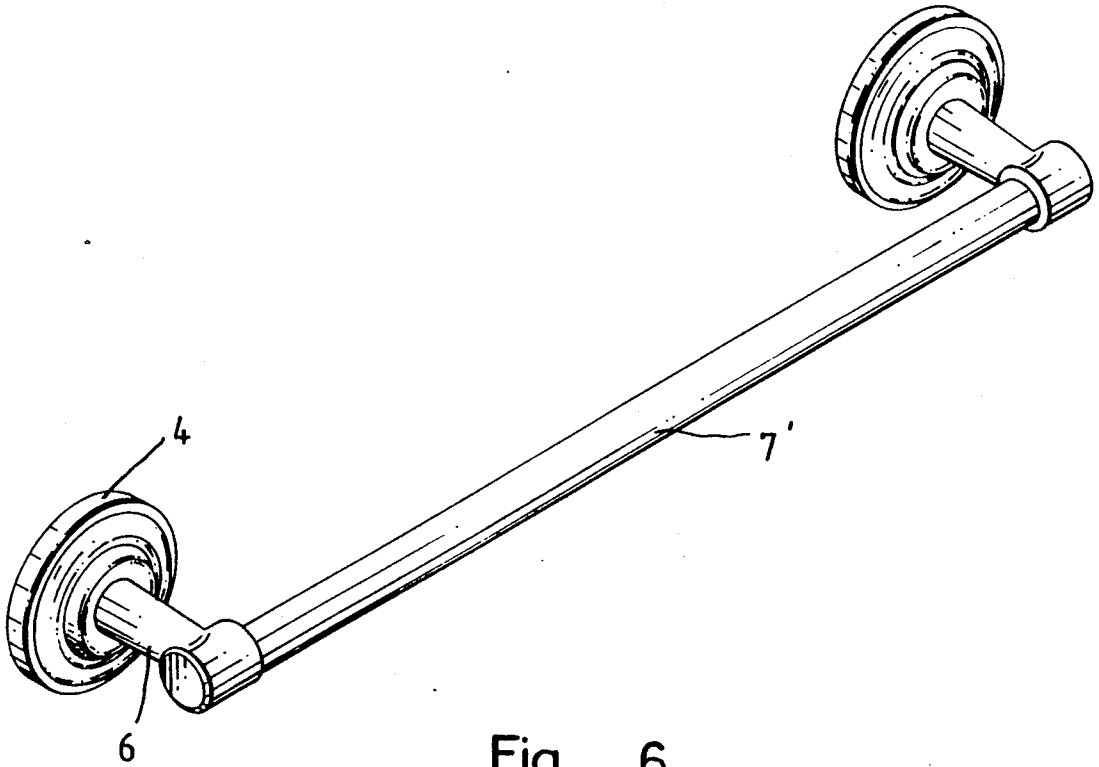
FIG. 6 illustrates an alternate form of the present invention.

Referring to FIGS. 5, 6 and 7, a towel support in accordance with the present invention includes a rigid mounting member 2 comprising a wall plate having elongated mounting holes 21'' to respectively match with anchors 13 set inside wall surface for easy fixation of the mounting member 2 onto the wall by means of flat head screws 14, and a stem 22 upstanding from its center. Because of the design of the elongated mounting holes 21'', a more flexible range is provided in aligning the mounting holes 21'' with the anchors 13 so that the flat head screws 14 can be straighly inserted in the anchors 13 to secure the mounting member 2 to the wall.

After the mounting member 2 is fixed onto the wall, a spring 3 is sleeved on the stem 22 of the mounting member 2, and a cover 4 which has a center hole 42 is covered on the mounting member 2 permitting the stem 22 to protrude beyond its center hole for the connection thereto of a hanging device 7 through a connector 6. As illustrated in FIG. 5, the hanging device 7 has a ring shaped body suitable for hanging towels, and the connector 6 is fixedly mounted on the hanging device 7 for securing the hanging device 7 to the taper stem 22 of the mounting member 2 to squeeze the spring 3 and the cover plate 4 in therebetween. The connector 6 includes an axial hole 61 for receiving the stem 22 of the mounting member 2, a bolt hole 62'' vertically in communication with the axial hole 61, and a screw rod 60'' movably secured in the bolt hole 62''. Because the stem 22 of the mountng member 2 has a tapered surface portion 23'', the connector 6 can be conveniently mounted on the stem 22 and firmly secured thereto by screwing down the screw rod 60'' onto the tapered surface portion 23'' without aiming the bolt hole 62'' to any specific point on the stem 22.

FIG. 6 illustrates an alternate form of the present invention, in which a rod-like hanging device 7' is connected to two mounting members 4 by means of two connectors 6.

I claim:

1. A towel support comprising a mounting member having holes formed therethrough for fastening said mounting member to a wall, said mounting member including a stem extending from a central portion thereof, said stem including an outer end portion terminating in a distal end remote from said mounting member, said outer end portion having a tapered outer surface thereon tapering from a smaller outer dimension to a larger outer dimension in a direction toward said distal end, a cover plate covering said mounting member and including an opening formed therethrough, said stem extending through said opening, spring means surrounding said stem and engaging said mounting member and said cover plate to urge said mounting member and said cover plate apart, a connector having a first hole formed therein receiving said outer end portion of the stem, said connector including a second hole intersecting said first hole and being threaded, a threaded bolt received in said second hole and including an inner end for engaging the tapered outer surface on the outer end portion of said stem to retain said outer end portion of the stem within said first hole in the connector, and a hanging device supported by said connector for supporting a towel.

2. A towel support as defined in claim 1 wherein said first hole in said connector is substantially complementary in configuration to the outer surface on the outer end portion of said stem.

3. A towel support as defined in claim 1 wherein said tapered outer surface is substantially frusto-conical in configuration.

4. A towel support as defined in claim 3 wherein in said holes formed in said mounting member are elongated to facilitate alignment with cooperating holes.

* * * * *